United States Patent [19]

Golovanov et al.

[11] 4,394,120

[45] Jul. 19, 1983

[54] BURNER

[75] Inventors: Alexandr V. Golovanov; Vladislav Y. Eschenko; Irsali K. Musaev; Zakhidzhan S. Talibdzhanov, all of Tashkent, U.S.S.R.

[73] Assignee: Sredneaziatsky Filial Vniipromgaz, Tashkent, U.S.S.R.

[21] Appl. No.: 272,347

[22] Filed: Jun. 10, 1981

[51] Int. Cl.[3] ..... F23Q 9/00

[52] U.S. Cl. ..... 431/284; 431/174; 239/422; 239/424; 239/426

[58] Field of Search ..... 431/174, 278, 284, 285, 431/187; 239/422, 423, 424, 426

[56] References Cited

U.S. PATENT DOCUMENTS

| | | | |
|---|---|---|---|
| 3,576,384 | 4/1971 | Peczeli et al. | 239/424 |
| 4,245,980 | 1/1981 | Reed et al. | 431/284 X |
| 4,260,367 | 4/1981 | Markowski et al. | 431/284 X |
| 4,285,664 | 8/1981 | Voorheis | 431/284 |

FOREIGN PATENT DOCUMENTS

| | | | |
|---|---|---|---|
| 1060082 | 6/1959 | Fed. Rep. of Germany . | |
| 191734 | 4/1967 | U.S.S.R. . | |
| 544833 | 2/1977 | U.S.S.R. | 431/284 |

OTHER PUBLICATIONS

Reversible Pulverized-Coal and Gas Burner with Adjustable Torch, Moscow 1980 (with translation).

*Primary Examiner*—Samuel Scott
*Assistant Examiner*—Margaret A. Focarino
*Attorney, Agent, or Firm*—Fleit, Jacobson & Cohn

[57] ABSTRACT

A burner according to the invention comprises concentrical shells defining annular passages: a peripheral passage for a low-calorie gas; an intermediate passage for secondary gas having auxiliary shells defining an annular passage for a high-calorie gas and a central passage for an air mixture. The circle of an average diameter of said annular passage for a high-calorie gas defines in the outlet section a central zone which amounts to between 0.38 and 0.5 of the total area of the outlet section of the burner, and the outer shells of the peripheral passage and intermediate passage are provided with converging nozzles of equal minimum diameters.

2 Claims, 2 Drawing Figures

BURNER

FIELD OF THE ART

The present invention relates to blow burners, and more particularly, to burners to be used for burning several kinds of fuel in a concurrent and separate manner.

SCOPE OF APPLICATION

The invention may be used in steam generators and in furnaces heated with several kinds of fuel, including low-calorie gases, such as blast furnace gases for a highly effective utilization of fuel.

BACKGROUND OF THE INVENTION

In view of a material rise of cost of organic fossile fuels their partial replacement with secondary energy sources without hampering the effectiveness of combination is a very actual problem in all industrially developed countries.

Known in the art are burner devices for burning different kinds of solid, liquid and gaseous fuels exhibiting different thermophysical properties, comprising concentrical annular passages for feeding air and fuels (cf. the books by Speysher V. A., Gorbanenko A. D. "Improvement of the Efficiency of the Use of Gas and Fuel Oil in Energy Production Plants", M., Energia Publ., 1974, p. 208; Maslov V. I., "Operation of Boiler Units in Ferrous Metal Production", M., Energia Publ., 1965, p. 296; Vnukov A. K., Reliability and Effectiveness of Boilers for Gas and Fuel Oil, M., L., Energia Publ., 1966, p. 368).

At present some designs of burners make it possible to ensure a highly efficient burning of different types of fuel in a concurrent and separate manner of fuel feeding so as to facilitate the fuel consumption, and the formation of nitrogen oxides may be substantially lowered by adding low-calorie gases.

Known in the art is a burner for burning gases of different calorific capacity, comprising concentrically arranged annular passages for feeding blast-furnace gas (a peripheral passage), air and a high-calorie gas successively to the center (cf. German Pat. No. 1,060,082, Cl. 24 C, 10). In such burner, the outlet zone of the peripheral passage is provided with a converging nozzle, the diameter of the outlet section of the converging nozzle is greater than the diameter of the air passage therein, and the outlet end faces of all passages are in one end the same plane.

The disadvantage of such burner consists in that the intensity of formation of a mixture of blast-furnace gas with air is inadequate, and an intense heating of the outlet zone of the peripheral blast-furnace gas passage with radiated heat when this passage is disconnected lowers the reliability of operation.

Known in the art is a burner comprising an annular passage with an axial-and-vane type vortex chamber in the outlet portion thereof and passages for air and coal dust supply arranged in and concentrically with the annular passage (cf. USSR Inventor's Certificate No. 191,734, Cl. F 23 D 17/00, 1967). The cylindrical outlet portion of the peripheral blast-furnace gas passage in such burner is greater than the diameter of the intermediate air passage accommodating gas supply tubes for feeding natural and coke gases.

This combination burner is deficient in an inadequate efficiency of mixture formation and an intense heating of the outlet members of the blast-furnace gas passage upon its disconnection.

The above disadvantages are caused by a concurrent development of annular flows of blast-furnace gas and air with substantially equal velocities and by the absence of cooling of the peripheral portion of the burner when the blast-furnace gas is disconnected. Angle coefficients for radiation of the fuel spray incident upon non-cooled members are sufficient for their overheating with actual heat fluxes from fuel sprays of the burner proper and from adjacent burners owing to a difference in diameters of the blast-furnace gas and air passages.

Known in the art is a burner comprising coaxially arranged passages: a passage for secondary air and high-calorie gas and primary air passages coaxial therewith. The outer cylindrical wall of the high-calorie gas passage is the inner wall for the secondary air passage and the inner cylindrical wall is the outer wall for an air mixture passage (cf. Talibdzhanov Z. S., Golovanov A. V., Reversible Dust, Gas and Fuel Oil Burners with Adjustable Fuel Spray, in the paper, Gas Applications in the National Economy, M., VNIIEGazprom, 1975, pp. 3–12).

This burner enables an efficient burning of a solid constant composition fuel in a concurrent and separate manner with fuel gases.

The disadvantage of this burner resides in hampered combustion performance in case the composition of solid fuel substantially deviates from the design composition.

In addition, after a continuous burning of abrasive dust of a solid fuel the wall separating the passages for air mixture and high-calorie gases is rapidly worn to result in an explosion hazardous situation.

SUMMARY OF THE INVENTION

It is an object of the invention to improve the efficiency of a concurrent and separate combustion of a varying-composition solid fuel, liquid and various gaseous fuels with their concurrent and separate consumption.

Another object of the invention is to adapt the burner design to a large range of solid fuels within the entire range of quality of coals for different dust preparation systems.

It is further object of the invention to improve the reliability in operation of the outlet members of the burner.

These objects are accomplished by that in a burner comprising concentrical shells defining annular passages: a peripheral passage for a low-calorie gas, an intermediate passage for secondary air provided with auxiliary shells defining an annular passage for a high-calorie gas and a central passage for an air mixture, according to the invention, the circle defined by the average diameter of the annular passage for a high-calorie gas defines in the outlet section a central zone which amounts to between 0.38 and 0.5 of the total area of the outlet section of the burner, and the outer shells of the peripheral passage and intermediate passage are provided with converging nozzles of equal minimum diameters.

The distance between the end faces of the converging nozzles is preferably between 0.3 and 0.6 of their minimum diameters.

The above-defined design of the burner enables the separation of flows of a high-calorie gas mixture, if the latter is burnt, by an air flow so as to reduce the degree of ballasting of the root area of the coal dust spray with combustion products of a high-calorie gas and to ensure complete burning of coal dust when burnt concurrently with a high-calorie gas.

BRIEF DESCRIPTION OF DRAWINGS

The invention will now be described with reference to a specific embodiment illustrated in the accompanying drawings, in which.

Figure 2:
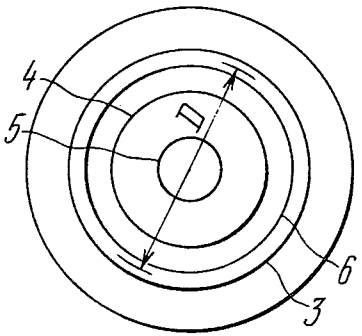
FIG. 2 is a sectional view taken along the line I—I in FIG. 1.
Figure 1:
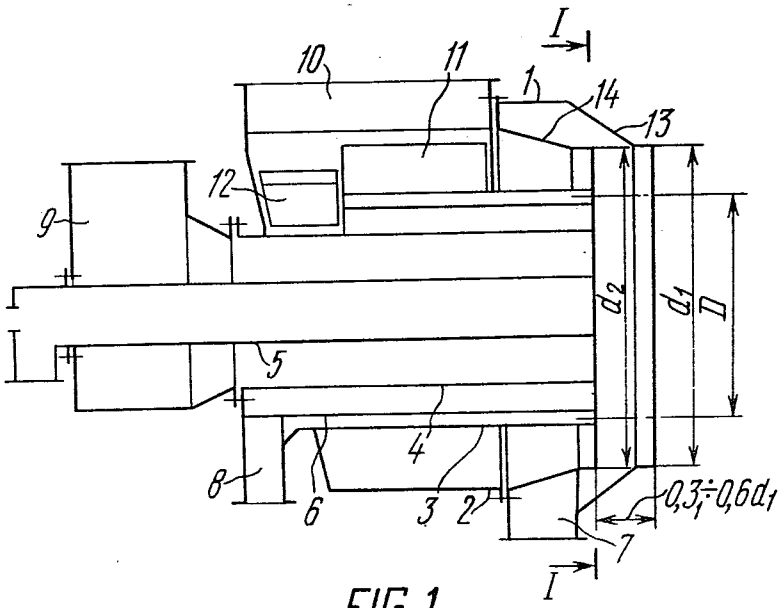
FIG. 1 is a longitudinal sectional view of a burner according to the invention.

A burner according to the invention comprises concentrically arranged shells defining passages on the outside: a shell 1 for a peripheral passage for a low-calorie gas; a shell 2 for an intermediate secondary air passage; a shell 3 for a high-calorie gas passage; a shell 4 for a passage for primary air or air mixture; a shell 5 of a pipe for the installation of a fuel oil injection nozzle and a shell 6 defining a passage for a high-calorie gas on the inside. The above-described passages communicate with admission pipes: a pipe 7 for admission of a low-calorie gas, a pipe 8 for a high-calorie gas, a pipe 9 for primary air or air mixture, a pipe 10 for secondary air having a shut-off and control valve 11 for adjusting the flow of secondary air in the passage between the shells 2 and 3 and a valve 12 for adjusting the flow of secondary air in the passage between the shells 4 and 6.

The shell 1 of the peripheral passage is provided with a converging nozzle 13 and the shell 2 of the intermediate passage is provided with a converging nozzle 14. The minimum diameter of the converging nozzle 13—$d_1$—is equal to the minimum diameter of the converging nozzle 14—$d_2$ and the distance between the end faces of the nozzles 13 and 14—l—is chosen within the range from 0.3 to 0.6 of their minimum diameters.

The shells 3 and 6 (FIG. 2) are installed in such a manner that the circle of the average diameter D of the passage defined by these shells for a high-calorie gas defines the central zone of an area amounting to between 0.38 and 0.5 of the total area of the outlet section of the burner.

Operation of the burner is as follows.

A low-calorie gas is admitted from the pipe 7 to the passage which is outwardly defined by the shell 1 and by the converging nozzle 13 and inwardly defined by the converging nozzle 14. Secondary air is fed into the passage between the shells 2 and 3 through the pipe 10 and the shut-off and control valve 11. The other part of the secondary air from the pipe 10 is admitted to the passage between the shells 4 and 6 through the shut-off and control valve 12. An air mixture or a part of air required for combustion is fed into the passage between the shells 4 and 5 through the pipe 9 which is equipped with a shut-off and control valve or with a vane stator, and a high-calorie gas is admitted to the passage defined by the shells 3 and 4 through the pipe 8 which is connected to a pipeline with fittings (not shown) outside the burner.

The process of mixture formation between a low-calorie gas and a part of secondary air occurs at a length of 0.3 to 0.6 of the minimum diameter of the converging nozzles 13 and 14 and this process is intensified owing to the development of intersection of air and low-calorie gas cones formed by the converging nozzle 13 and by the outlet end of the converging nozzle 14. Thanks to the equality of the minimum diameters $d_1$ and $d_2$ of the converging nozzles 13 and 14 the resultant flow is additionally compressed by the outlet end of the converging nozzle 13 thereby contributing to an intensified mixture formation.

In addition, the equality of the diameters $d_1$ and $d_2$ ensures a convective heat removal from the outlet members of the passage of a low-calorie gas even upon the disconnection of the passage.

In case a coal dust is burnt, a flow of air mixture formed in the annular passage between the shells 4 and 5 leaves into the zone of mixture formation with secondary air. Thanks to the presence of an air flow between the passage for a high-calorie gas and the dust passage, the gas cannot get into the dust duct and into the dust preparation system even upon substantial abrasive damages to the shell 4, and secondary air is admitted to the root zone of the coal dust spray without being ballasted with gas combustion products.

In case the composition of the coal being burnt changes even substantially, the provision of the passage between the shells 4 and 5 makes it possible to maintain the ratio of velocities of the air mixture and secondary air in their contact zone which is optimal for complete burning of new solid fuel owing to the re-distribution of flows of secondary air in the passage defined by the shells 4 and 6 and the passage defined by the shells 2 and 3 by means of shut-off and control valves 11 and 12.

This is made using a computed relationship of the ratio of the areas of the central zone, including the pipe for installation of an injection nozzle, the central passage and the air space between the shells 4 and 6, as well as the area of the ring from the inner surface of the shell 6 along a circle of the average diameter of the annular passage for a high-calorie gas to the total area of the outlet section of the burner. For burners with different sleeve ratio (the ratio of the outside diameter of the pipe for the installation of an injection nozzle to the inside diameter of the shell 4) this area ratio ranges from 0.38 to 0.5 and enables the supply of secondary air which is sufficient for complete burning of solid fuel to the root zone of the coal dust spray.

This re-distribution of air for the same purpose is also required upon a change in the ratio between fuels burnt in one and the same burner.

Combined combustion of different fuels in one and the same burner simplifies the fuel consumption, performance adjustment and set-up operations, and in applications where a certain quantity of low-calorie gases, such as blast-furnace gas, is burnt in the fuel mixture the formation of nitrogen oxides is reduced.

The burner according to the invention enlarges the range of fuels burnt in one and the same burner, improves the efficiency of combustion in a concurrent and separate manner, with better reliability and greater safety of operation of fuel-consuming plants and their fuel preparation systems. Adding low-calorie gases, such as blast-furnace gas makes it possible to reduce the content of nitrogen oxides in combustion products without lowering other combustion characteristics.

We claim:

1. A burner comprising: concentrical shells defining annular passages including: a peripheral passage for a low-calorie gas; an intermediate passage for secondary air having auxiliary shells defining an annular passage for a high-calorie gas; a central passage for an air mixture; the circle of an average diameter of said annular passage for a high-calorie gas defining in the outlet section a central zone which amounts to between 0.38 and 0.5 of the total area of the outlet section of the burner; converging nozzles of minimum diameters equal to one another, said converging nozzles being installed in the outer shells of said peripheral passage and of said intermediate passage.

2. A burner according to claim 1, wherein the distance between the end faces of said converging nozzles is from 0.3 to 0.6 of their minimum diameters.

* * * * *